US011306527B2

(12) United States Patent
Folie et al.

(10) Patent No.: US 11,306,527 B2
(45) Date of Patent: Apr. 19, 2022

(54) FURNITURE FITTING

(71) Applicant: Julius Blum GmbH, Hoechst (AT)

(72) Inventors: Thomas Folie, Dornbirn (AT); Stefan Duer, Schwarzach (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 17/112,375

(22) Filed: Dec. 4, 2020

(65) Prior Publication Data

US 2021/0087867 A1 Mar. 25, 2021

Related U.S. Application Data

(63) Continuation of application No. PCT/AT2019/060195, filed on Jun. 13, 2019.

(30) Foreign Application Priority Data

Jul. 3, 2018 (AT) ..... A 50576/2018

(51) Int. Cl.
*E05D 7/12* (2006.01)
*E05F 5/00* (2017.01)
(Continued)

(52) U.S. Cl.
CPC ..... *E05F 5/006* (2013.01); *E05F 3/20* (2013.01); *E05F 5/10* (2013.01); *E05Y 2900/20* (2013.01)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 4,050,116 A * 9/1977 Salice ..... E05D 11/1021 16/288
4,099,293 A 7/1978 Pittasch
(Continued)

FOREIGN PATENT DOCUMENTS

CN 105781291 7/2016
CN 107002442 8/2017
(Continued)

OTHER PUBLICATIONS

International Search Report dated Sep. 10, 2019 in International (PCT) Application No. PCT/AT2019/060195.
(Continued)

*Primary Examiner* — Chuck Y Mah
(74) *Attorney, Agent, or Firm* — Wenderoth, Lind & Ponack, L.L.P.

(57) ABSTRACT

A furniture fitting includes a first fitting portion to be fixed to a furniture panel, and a second fitting portion to be fixed to a movably-mounted furniture part, the second fitting portion being pivotally connected to the first fitting portion. The first fitting portion includes a mounting portion having a fastening device for mounting the mounting portion to the furniture panel, and the first fitting portion includes a coupling portion hingedly connected to the second fitting portion. The coupling portion is releasably connected to the mounting portion, and the mounting portion includes a housing. The coupling portion, when connected with the mounting portion, is received within the housing. The coupling portion is releasably connected to the mounting portion by a locking device, the locking device including a movably-mounted locking element for releasably locking the coupling portion, and the locking element is pressurized by a force storage member.

22 Claims, 4 Drawing Sheets

(51) Int. Cl.
*E05F 3/20* (2006.01)
*E05F 5/10* (2006.01)

(58) Field of Classification Search
CPC .... E05F 5/02; E05F 3/20; E05F 11/54; E05D 3/16; E05D 11/00; E05D 15/40; E05D 2003/163; E05D 3/06; E05D 7/10; E05D 7/12; E05D 7/1061; E05D 2007/1094; E05Y 2201/10; E05Y 2201/256; E05Y 2201/21; E05Y 2201/264; E05Y 2201/47; E05Y 2201/492; E05Y 2900/20; E05Y 2900/202; E05Y 2600/10; E05Y 2600/41; A47B 2220/0072; Y10T 16/5383; Y10T 16/547; Y10T 16/5476; Y10T 16/5321; Y10T 16/5322; Y10T 16/53225; Y10T 16/5367
See application file for complete search history.

(56) References Cited

U.S. PATENT DOCUMENTS

| | | | | |
|---|---|---|---|---|
| 4,114,237 | A | 9/1978 | Grass | |
| 5,056,189 | A * | 10/1991 | Brustle | E05D 7/125 16/235 |
| 6,032,333 | A * | 3/2000 | Brustle | E05D 7/0407 16/242 |
| 7,966,699 | B2 * | 6/2011 | Dubach | E05D 7/123 16/386 |
| 8,321,996 | B2 * | 12/2012 | Hirtsiefer | E05D 15/46 16/286 |
| 9,169,681 | B2 * | 10/2015 | Cooper | E05F 5/006 |
| 9,739,081 | B2 * | 8/2017 | Stuke | E05F 5/006 |
| 10,113,346 | B2 * | 10/2018 | Kohlweiss | E05D 5/128 |
| 10,214,951 | B2 | 2/2019 | Liang | |
| 10,221,597 | B2 | 3/2019 | Hammerer | |
| 10,407,963 | B2 | 9/2019 | Salice | |
| 2007/0193572 | A1 * | 8/2007 | Lee | E05D 7/12 126/194 |
| 2007/0257538 | A1 * | 11/2007 | Brunnmayr | E05D 15/262 297/423.12 |
| 2013/0239363 | A1 * | 9/2013 | Apur | E05F 5/006 16/50 |
| 2015/0330128 | A1 * | 11/2015 | Ng | E05D 7/0407 16/65 |
| 2017/0241175 | A1 | 8/2017 | Hammerer | |
| 2018/0135344 | A1 | 5/2018 | Liang | |
| 2018/0252016 | A1 | 9/2018 | Salice | |
| 2021/0148149 | A1 * | 5/2021 | Pleuteri | E05D 3/12 |

FOREIGN PATENT DOCUMENTS

| | | | | |
|---|---|---|---|---|
| DE | 2608142 | | 5/1977 | |
| DE | 25 54 130 | | 6/1977 | |
| EP | 0 881 348 | | 12/1998 | |
| EP | 1 050 651 | | 11/2000 | |
| EP | 3 252 255 | | 12/2017 | |
| EP | 3401477 | A1 * | 11/2018 | E05D 15/401 |
| JP | 2008-25270 | | 2/2008 | |
| JP | 2018-514670 | | 6/2018 | |
| WO | 2005/108726 | | 11/2005 | |
| WO | 2008/135023 | | 11/2008 | |
| WO | 2009/013129 | | 1/2009 | |
| WO | 2016/090391 | | 6/2016 | |
| WO | 2016/156514 | | 10/2016 | |
| WO | 2016/174071 | | 11/2016 | |

OTHER PUBLICATIONS

Search Report dated Jan. 6, 2022 in Chinese Patent Application No. 201980043685.9.

* cited by examiner

FURNITURE FITTING

BACKGROUND OF THE INVENTION

The present invention relates to a furniture fitting for movably supporting a furniture part movably-mounted relative to a furniture carcass. The furniture fitting includes a first fitting portion configured to be fixed to a, preferably substantially horizontally aligned, furniture panel of the furniture carcass, and a second fitting portion configured to be fixed to the movably-mounted furniture part, in which the second fitting portion being pivotally connected to the first fitting portion. The first fitting portion includes a mounting portion having at least one fastening device for mounting the mounting portion to the furniture panel, and the first fitting portion includes at least one coupling portion hingedly connected to the second fitting portion. The coupling portion is configured to be releasably connected to the mounting portion, and the mounting portion of the first fitting portion includes a, preferably pocket-shaped, housing. The coupling portion, in a connected condition with the mounting portion, is received, for the most part, within the housing of the mounting portion.

Moreover, the invention concerns an item of furniture comprising a furniture carcass and a movable furniture part which is pivotally supported relative to the furniture carcass by at least one furniture fitting of the type to be described.

WO 2016/174071 A1 shows in FIG. 9 a furniture hinge for pivotally supporting a door, and the first fitting portion of the furniture hinge is countersunk is an elongated-shaped recess of a furniture panel of the furniture carcass. The second fitting portion of the furniture hinge is also received within an elongated-shaped recess of the movable furniture part.

EP 0 881 348 A1 discloses a hinge fitting having a door-sided fitting portion configured to be fixed to a door, a carcass-sided fitting portion configured to be fixed to the furniture carcass, and the carcass-sided fitting portion is hingedly connected to the door-sided fitting portion. The door-sided fitting portion includes a support body to be fixed to the furniture carcass, the support body being configured to be releasably connected by screws to a coupling portion of the hinge fitting.

WO 2016/090391 A1 discloses a furniture hinge having a carcass-sided fitting portion configured to be releasably latched with a (not shown) mounting plate by a spring-loaded locking lever, and the mounting plate is configured to be pre-mounted to the furniture carcass.

Upon mounting a movable furniture part to a furniture carcass, the furniture fitting is usually firstly pre-mounted to the movable furniture part. Subsequently, the movable furniture part, with the furniture fitting pre-mounted thereon, is approached to the furniture carcass, and it is thereby intended to introduce the first fitting portion into the provided recess of the furniture panel. Thereby, problems upon mounting may occur insofar because the movable furniture part, depending on its configuration, may have a considerable weight, and also because of the fact that the recess of the furniture panel must be precisely adapted to the form and size of the first fitting portion. Accordingly, the introduction of the first fitting portion into the recess of the furniture panel may, in fact, be connected with an expenditure of time and with a manually exhausting work process.

JP 2008-025270 A discloses a furniture hinge having a hinge housing which is to be fixed to a furniture part in a first mounting step. In a following mounting step, an adjustment block is inserted into a cavity of the pre-mounted hinge housing, and the adjustment block is connected to the hinge housing by screws.

SUMMARY OF THE INVENTION

It is an object of the present invention to propose a furniture fitting of the type mentioned in the introductory part, thereby avoiding the above-discussed drawbacks.

According to the invention, the coupling portion is configured to be releasably connected to the mounting portion by at least one locking device. The at least one locking device includes at least one movably-mounted locking element for releasably locking the coupling portion, and the at least one locking element is pressurized by at least one force storage member.

The feature of the locking device is certainly not an obvious measure in view of the JP 2008-025270 A reference, because it is quite unclear for the person skilled in the art, with a hinge housing countersunk into the furniture part, where to arrange the locking elements for releasably locking the coupling portion.

The carcass-sided first fitting portion of the furniture fitting has at least a two-part configuration and includes a mounting portion configured to be fixed, in a first mounting step, to or within a, preferably substantially horizontally aligned, furniture panel of the furniture carcass by at least one fastening device. Further provided is a coupling portion hingedly connected to the second fitting portion, and the coupling portion, in a second mounting step, is to be fixed—independently and separately from the mounting portion—to the movable furniture part. After the mounting portion and the coupling portion have been pre-mounted, these components can be releasably connected to one another by the locking device in a third mounting step, thus automatically locked to one another.

According to the invention, the mounting portion of the first fitting portion is configured to be inserted into a recess of the furniture panel, so that the mounting portion, in a mounted condition on the furniture panel, is, for the most part, preferably substantially entirely, received within the recess of the furniture panel. In this way, a compact and visually unobtrusive arrangement of the mounting portion on the furniture carcass can be provided.

The item of furniture comprises a furniture carcass having a, preferably substantially horizontally aligned, furniture panel (for example a bottom panel, a top panel, a shelf arranged between the bottom panel and the top panel, or a vertically extending sidewall), and the mounting portion is supported on the furniture panel. It is preferable that the mounting portion, in the mounted position, is for the most part received within a recess of the furniture panel.

The furniture panel of the furniture carcass usually has a predetermined material thickness (for example 16 mm or 19 mm). According to a preferred embodiment, the mounting portion of the first fitting portion is configured to be received within the predetermined material thickness of the furniture panel. The mounting portion can have a height extension and a length extension, and the length extension of the mounting portion is at least three times, preferably at least six times, as large than the height extension of the mounting portion.

For example, the furniture fitting can be configured as a furniture hinge. However, it is also possible that the furniture fitting is configured as a furniture drive for moving a furniture flap, the flap being pivotally supported about a horizontally extending axis in the mounted condition on the furniture carcass.

BRIEF DESCRIPTION OF THE DRAWINGS

Further details and advantages of the present invention will be explained with the aid of the embodiment shown in the drawings, in which.

DETAILED DESCRIPTION OF THE INVENTION

Figure 1A:
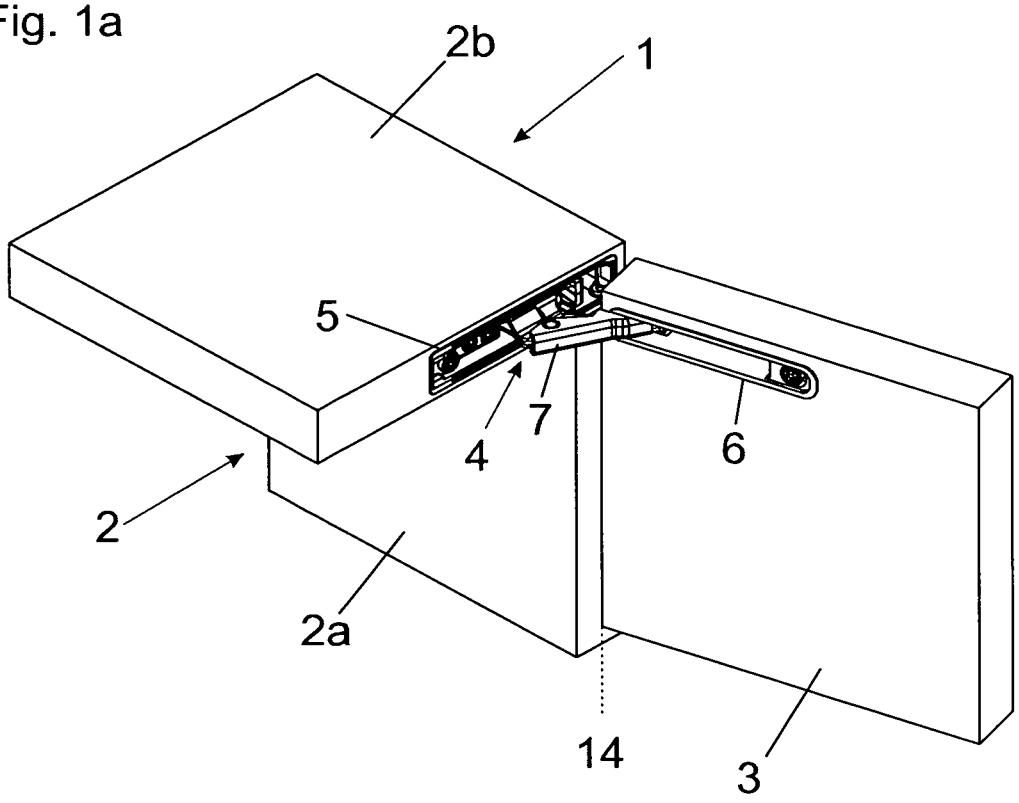
FIG. 1*a*, 1*b* show an item of furniture and a furniture fitting (without the mounting portion) in perspective views.

FIG. 1*a* shows a perspective view of an item of furniture 1 with a furniture carcass 2 (only partially depicted). A movable furniture part 3, preferably in the form of a door or a furniture flap, is pivotally supported in the mounted position about an, preferably vertically extending, axis 14 relative to the furniture carcass 2 by a furniture fitting 4. The furniture carcass 2 includes a vertically extending sidewall 2*a* and a horizontally extending furniture panel 2*b* (preferably a top panel, a bottom panel or a shelf arranged between the top panel and the bottom panel), and the first fitting portion 5 of the furniture fitting 4 is supported on or within the furniture panel 2*b*. Of course, it is also possible for the furniture fitting 4 to be fixed to the vertically extending sidewall 2*a*, so that the movable furniture part 3, in the mounted condition, is pivotally supported relative to the furniture carcass 2 about a horizontally extending axis 14.

In the shown embodiment, it is provided that the first fitting portion 5 is substantially entirely received within a first recess 15*a* (FIG. 2*a*) of the furniture panel 2*b*, whereas the second fitting portion 6 of the furniture fitting 4 is substantially entirely received within a second recess 15*b* (FIG. 2*b*) of the movable furniture part 3.

Figure 1B:
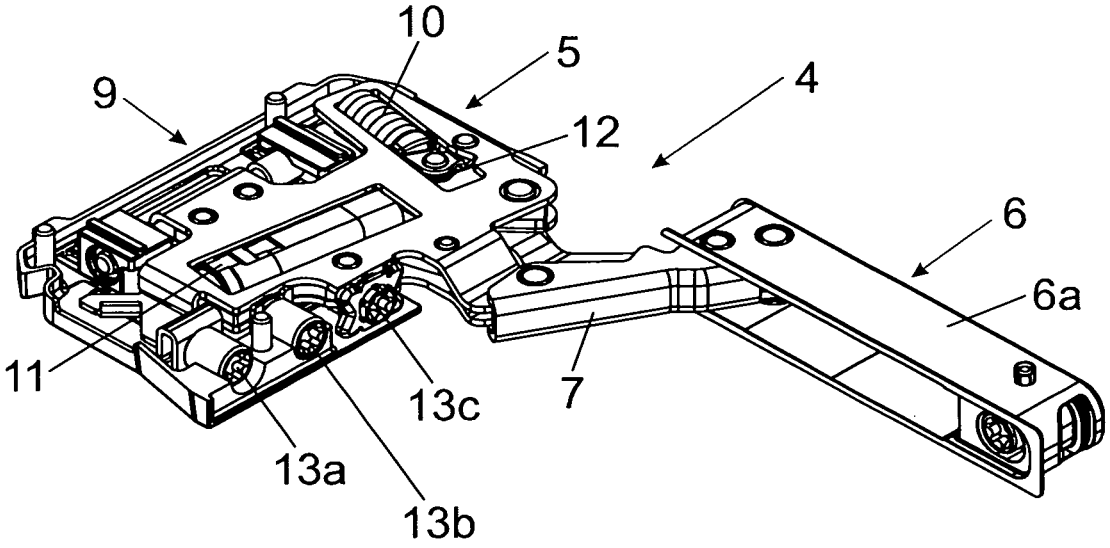
Figure 3A:
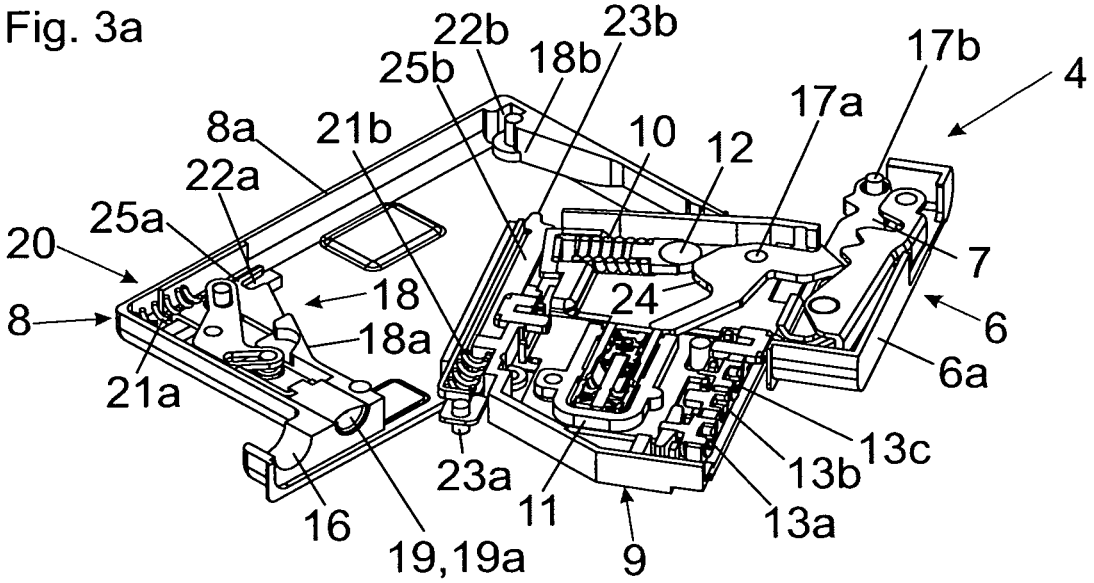
FIG. 3*a*-3*c* show a temporal sequence of the mounting procedure of the coupling portion on the mounting portion in different cross-sectional views.

FIG. 1*b* shows the furniture fitting 4 (without the mounting portion 8) in a perspective view. The first fitting portion 5 has at least a two-part configuration and includes a mounting portion 8 (FIG. 3*a*) configured to be pre-mounted to or within the furniture panel 2*b*, the mounting portion 8 having a, preferably pocked-shaped, housing 8*a* for at least partially receiving the coupling portion 9. The mounting portion 8 and the coupling portion 9 are configured to be releasably connected to one another. In a first mounting step, the mounting portion 8 is to be fixed to or within the furniture panel 2*b*. The coupling portion 9 is pivotally connected to the second fitting portion 6 by at least one hinged lever 7. The second fitting portion 6, in a second mounting step, is to be fixed to the movable furniture part 3 by a, preferably longitudinally extending, housing 6*a*. After the mounting portion 8 has been fixed to the furniture panel 2*b* and the second fitting portion 6 has been fixed to the movable furniture part 3, the mounting portion 8 and the coupling portion 9 can be connected to one another by joining them together. The mounting portion 8 and the coupling portion 9 are configured to be automatically locked to one another by at least one locking device 20 (FIG. 3*a*).

By at least one adjustment device 13*a*, 13*b*, 13*c*, in a connected condition between the mounting portion 8 and the coupling portion 9, a position of the coupling portion 9 relative to the mounting portion 8 can be adjusted, preferably in a three-dimensional manner. By a force of a spring device 10, the second fitting portion 6 is movable into a fully closed and/or fully open position relative to the first fitting portion 5. For example, this can be provided by a pressure roller 12 pressurized by the spring device 10. The pressure roller 12 is configured to run along a setting contour 24 (FIG. 3*a*) upon a movement of the hinged lever 7. By a damping device 11, preferably with a hydraulic piston-cylinder-unit, a movement of the second fitting portion 6 relative to the first fitting portion 5 can be decelerated. In this way, a movement of the second fitting portion 6 into the fully closed and/or fully open end-position can be dampened.

Figure 2A:
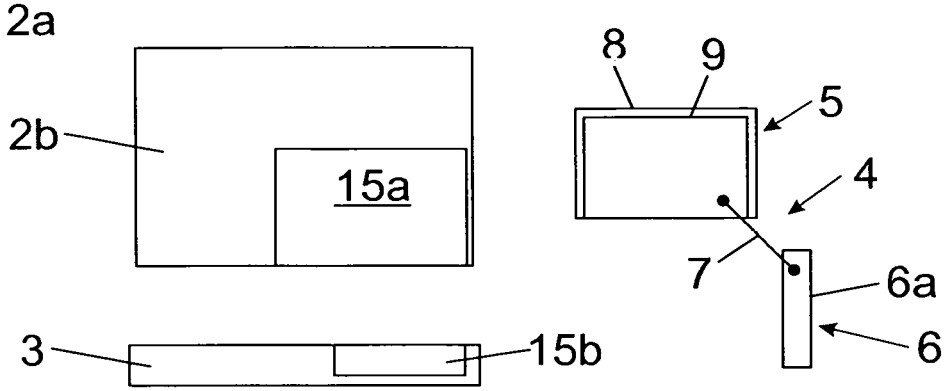
FIG. 2*a*-2*c* show the mounting procedure of the movable furniture part on the furniture carcass in schematic top views.
Figure 2B:
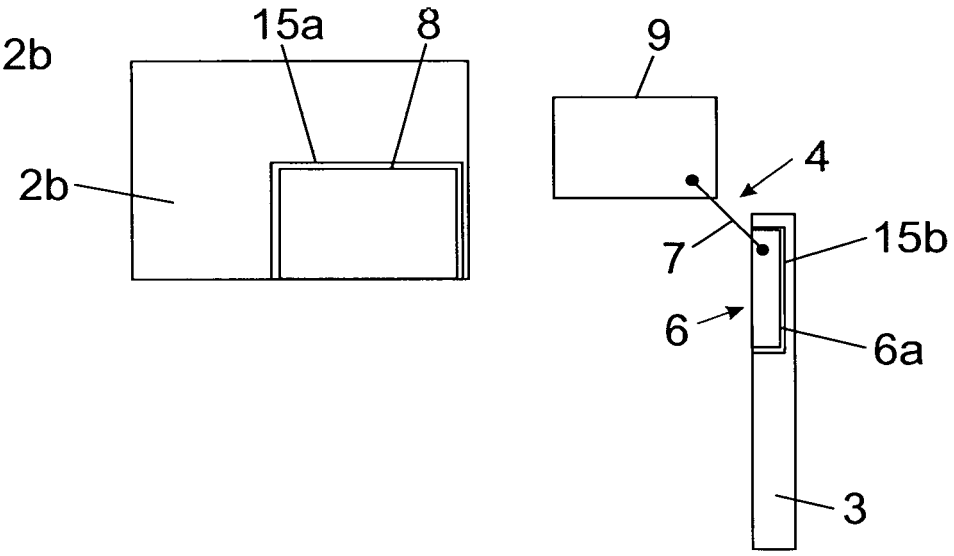
Figure 2C:
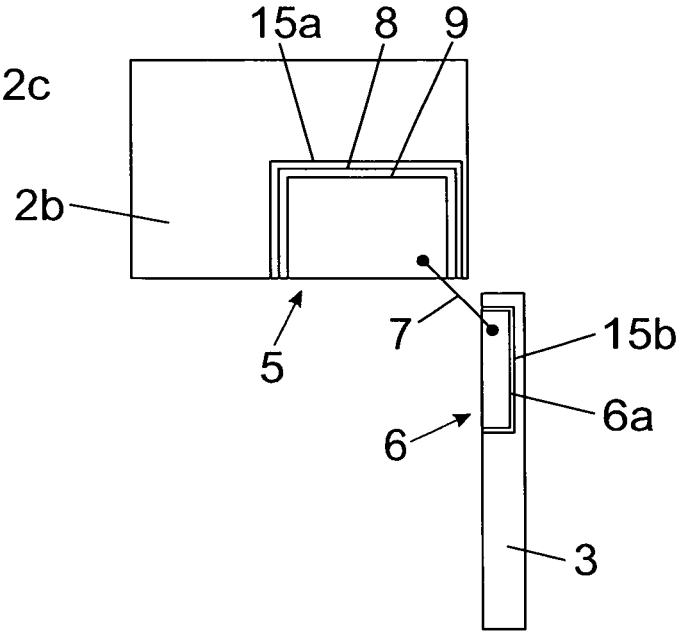

FIG. 2*a*-2*c* show the mounting procedure of the movable furniture part 3 on the furniture panel 2*b* of the furniture carcass 2 in schematic top views. A first recess 15*a* is formed in the furniture panel 2*b* for receiving the first fitting portion 5 of the furniture fitting 4, whereas a second recess 15*b* is arranged in the movable furniture part 3 for receiving the second fitting portion 6 of the furniture fitting 4. The first fitting portion 5 has at least a two-part configuration and includes a mounting portion 8 configured to be arranged in the first recess 15*a*, and a coupling portion 9 configured to be connected to the mounting portion 8. The first fitting portion 5 and the second fitting portion 6 are pivotally connected to one another by at least one hinged lever 7.

In a first mounting step (FIG. 2*b*), the mounting portion 8 is fixed within the first recess 15*a* of the furniture panel 2*b*, whereas the second fitting portion 6 is to be fixed to the movable furniture part 3. It is preferably provided that the longitudinal housing 6*a* of the second fitting portion 6 is configured to be substantially entirely countersunk in the second recess 15*b* of the movable furniture part 3. In a third mounting step (FIG. 2*c*), the mounting portion 8 and the coupling portion 9 are connected to one another, so that the movable furniture part 3 can be fixed to the furniture carcass 2.

Figure 3B:
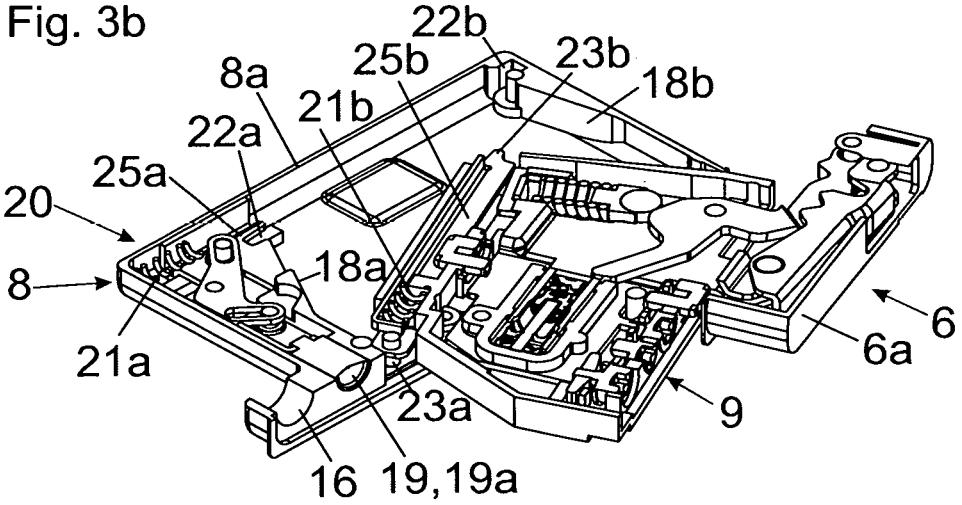
Figure 3C:
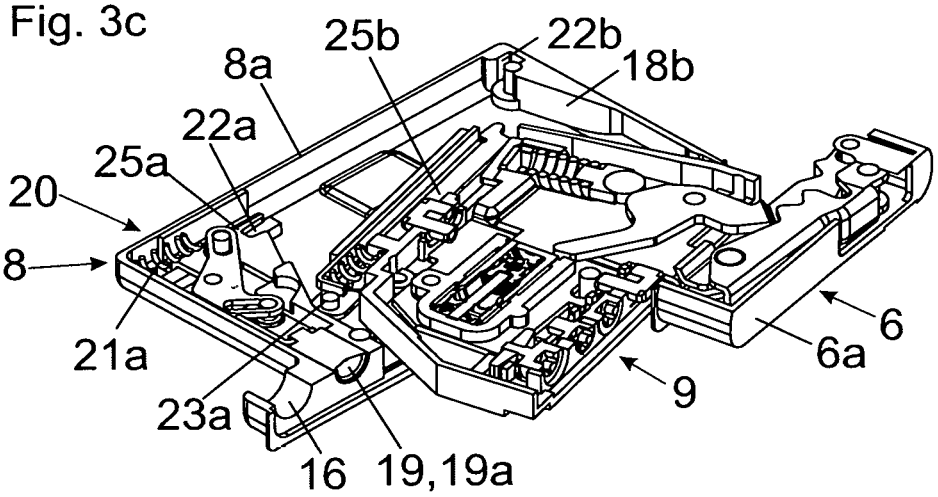

FIG. 3*a*-3*c* show the mounting procedure of the coupling portion 9 on the mounting portion 8 in different mounting steps. The coupling portion 9 is connected to the second fitting portion 6 by at least one hinged lever 7. The hinged lever 7 is pivotally supported on the coupling portion 9 about a first hinge axis 17*a*, and is pivotally supported on the second fitting portion 6 about a second hinge axis 17*b*. A setting contour 24 is arranged on the hinged lever 7, and a pressure roller 12 pressurized by the spring device 10 is configured to run along the setting contour 24 upon a movement of the hinged lever 7 about the first hinge axis 17*a*. The hinged lever 7 is configured as a double-armed lever having a first lever end and a second lever end. The first lever end of the hinged lever 7 is hingedly connected to the second fitting portion 6 via the second hinge axis 17*b*. The damping device 11 is configured to be acted upon by the second lever end of the hinged lever 7. The second lever end of the hinged lever 7, for performing a damping hub, can act on the damping device 11 either directly or via at least one further component (for example via an intermediate lever). In a first mounting step, the mounting portion 8 is to be fixed by at least one fastening device 16 (which may be configured, for example, as a hole for receiving a screw) to or within the furniture panel 2*b*.

The mounting portion 8 can also include two or more fastening devices 16 configured as holes for receiving screws. It is also possible that the fastening device 16 includes a movably-mounted actuating element, and at least one locking portion is configured to be moved by an actuation of the actuating element. By the locking portion, the mounting portion 8 can be fixed to or within the furniture panel 2*b* in a force-locking manner.

In a further mounting step, the coupling portion 9 is inclinedly introduced into the pocket-shaped housing 8*a* of the mounting portion 8. Moreover, a centering device 18 for centering between the mounting portion 8 and the coupling portion 9 is provided. The centering device 18 includes at least one inclined surface 18*a*, 18*b* formed or arranged on the mounting portion 8 and/or on the coupling portion 9 for guiding the coupling portion 9.

For releasably locking between the coupling portion 9 and the mounting portion 8, at least one locking device 20 is provided. The locking device 20 includes at least one movably mounted locking element 25*a* for releasably locking the coupling portion 9. The locking element 25*a* is pressurized by a force storage member 21*a*, preferably configured as a compression spring. The locking element 25*a* is provided with a recess 22*a* for receiving a locking member 23*a* of the coupling portion 9. In the shown embodiment, a second force storage member 21*b* is provided, the second force storage member 21*b* being configured to push a second locking element 25*b* having a second locking member 23*b* in a direction of a second recess 22*b* of the mounting portion 8. As shown in FIG. 3*b* and FIG. 3*c*, the coupling portion 9 is laterally pivoted into the mounting portion 8, and the coupling portion 9 can be guided relative to the mounting portion 8 by the inclined surfaces 18*a*, 18*b* of the centering device 18.

Figure 4A:
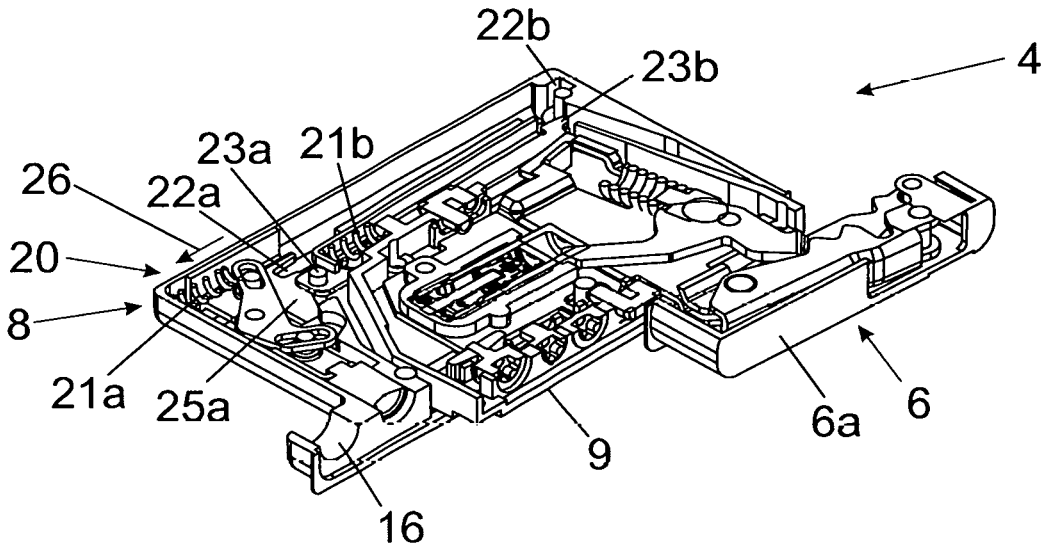
FIG. 4*a*, 4*b* show further temporal sequences of the mounting procedure of the coupling portion on the mounting portion in different cross-sectional views.

FIG. 4*a* shows, in relation to FIG. 3*c*, a continued pivoting movement of the coupling portion 9 relative to the mounting portion 8. The locking element 25*a* is pushed, against a force of the force storage member 21*a*, in a direction of the depicted arrow 26 due to the co-operation of the locking member 23*a* with an inclined surface of the locking element 25*a*. As a result, the locking member 23*a* can enter into the recess 22*a* of the locking element 25*a* and the second locking member 23*b* can be pressed into the recess 22*b* of the mounting portion 8 by a force of the second force storage member 21*b*.

Figure 4B:
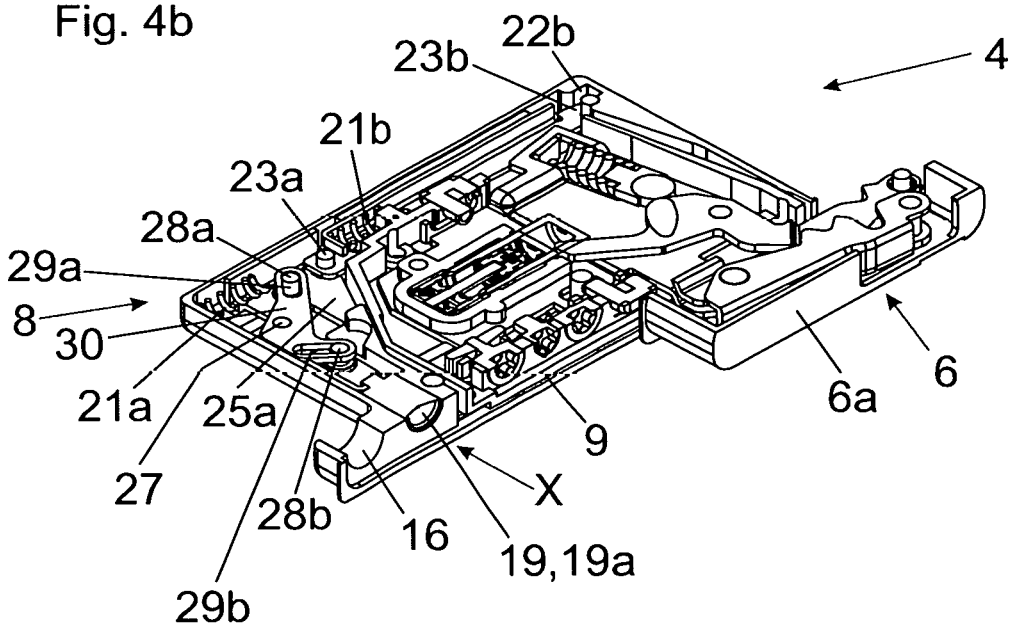

FIG. 4*b* shows the locked position between the mounting portion 8 and the coupling portion 9. By an unlocking device 19, the locking between the mounting portion 8 and the coupling portion 9 can be again released. The unlocking device 19 includes a movably-mounted, preferably linearly displaceable, release element 19*a*. By exerting a force to the release element 19*a* in the direction (X), the locking between the mounting portion 8 and the coupling portion 9 is configured to be released. The release element 19*a*, in a mounted condition of the furniture fitting 4, is immediately and directly accessible for an actuation with the aid of a tool.

In the shown embodiment, the unlocking device 19 includes a two-armed unlocking lever 30 pivotally supported about an axis 27. Elongated holes 29*a*, 29*b* are provided on both lever ends of the two-armed unlocking lever 30, the elongated holes 29*a*, 29*b* being provided for receiving pins 28*a*, 28*b*. The first pin 28*a* is arranged on the locking element 25*a*, whereas the second pin 28*b* is connected to the release element 19*a*. When the release element 19*a* is pushed in a direction of the arrow (X) with the aid of a tool, preferably by a screwdriver, the locking element 25*a* is movable by the unlocking lever 30, against a force of the force storage member 21*a*, into a release position in which the locking between the mounting portion 8 and the coupling portion 9 can be released.

The invention claimed is:

1. A furniture fitting for movably supporting a furniture part movably-mounted relative to a furniture carcass, the furniture fitting comprising:

a first fitting portion configured to be fixed to a furniture panel of the furniture carcass; and a second fitting portion configured to be fixed to the furniture part, the second fitting portion being pivotally connected to the first fitting portion, wherein:

the first fitting portion includes a mounting portion having at least one fastening device for mounting the mounting portion to the furniture panel, and the first fitting portion includes at least one coupling portion hingedly connected to the second fitting portion, the at least one coupling portion being configured to be releasably connected to the mounting portion;

the mounting portion includes a pocket-shaped housing, and the at least one coupling portion is configured such that, in a connected condition with the mounting portion, a majority of the at least one coupling portion is received within the pocket-shaped housing of the mounting portion;

the at least one coupling portion is configured to be releasably connected to the mounting portion by at least one locking device, the at least one locking device including at least one movably-mounted locking element for releasably locking the at least one coupling portion, and the at least one movably-mounted locking element is pressurized by at least one force storage member; and the mounting portion has a height extension and a length extension, and the length extension of the mounting portion is at least three times as large as the height extension of the mounting portion.

2. The furniture fitting according to claim 1, wherein the mounting portion is configured to be inserted into a recess of the furniture panel.

3. The furniture fitting according to claim 1, further comprising a centering device for centering between the mounting portion and the at least one coupling portion, wherein the centering device includes at least one inclined surface arranged or formed on the mounting portion and/or on the at least one coupling portion for guiding the at least one coupling portion.

4. The furniture fitting according to claim 1, further comprising an unlocking device for releasing the connection between the mounting portion and the at least one coupling portion.

5. The furniture fitting according to claim 4, wherein the unlocking device includes a movably-mounted release element, and the locking between the mounting portion and the at least one coupling portion is configured to be released by exerting a force to the movably-mounted release element.

6. The furniture fitting according to claim 5, wherein the movably-mounted release element is linearly displaceably supported.

7. The furniture fitting according to claim 1, further comprising at least one pivotally mounted hinged lever for moving the furniture part.

8. The furniture fitting according to claim 7, further comprising a spring device for applying a force to the at least one pivotally mounted hinged lever.

9. The furniture fitting according to claim 8, further comprising a pressure roller pressurized by the spring device, wherein the pressure roller is configured to be moved along a setting contour upon a movement of the at least one pivotally mounted hinged lever.

10. The furniture fitting according to claim 9, wherein the setting contour is arranged on the at least one pivotally mounted hinged lever.

11. The furniture fitting according to claim 1, further comprising at least one damping device for dampening a relative movement between the first fitting portion and the second fitting portion.

12. The furniture fitting according to claim 7, wherein the at least one pivotally mounted hinged lever is a two-armed lever having a first lever end and a second lever end, the first lever end of the at least one pivotally mounted hinged lever being hingedly connected to the second fitting portion, and the furniture fitting further comprises at least one damping device for dampening a relative movement between the first fitting portion and the second fitting portion, the at least one damping device being configured to be acted upon by the second lever end of the at least one pivotally mounted hinged lever.

13. The furniture fitting according to claim 11, wherein the at least one damping device is a piston-cylinder-unit.

14. The furniture fitting according to claim 1, wherein the furniture fitting is a furniture hinge.

15. An item of furniture comprising:

the furniture fitting according to claim 1;

the furniture carcass; and the furniture part, wherein the furniture part is pivotally supported about an axis relative to the furniture carcass by the furniture fitting.

16. The item of furniture according to claim 15, wherein the axis extends vertically in a mounted position.

17. The item of furniture according to claim 15, wherein the mounting portion is supported on the furniture panel.

18. The item of furniture according to claim 17, wherein the furniture panel is horizontally aligned.

19. The item of furniture according to claim 17, wherein the furniture panel is a bottom panel, a top panel, a shelf arranged between the bottom panel and the top panel, or a sidewall.

20. The item of furniture according to claim 17, wherein the mounting portion is configured such that, in a mounted position, a majority of the mounting portion is received within a recess of the furniture panel.

21. The furniture fitting according to claim 1, wherein the length extension of the mounting portion is at least six times as large as the height extension of the mounting portion.

22. The furniture fitting according to claim 1, wherein the first fitting portion is configured to be fixed to the furniture panel which is horizontally aligned.

* * * * *